US007739904B2

(12) United States Patent
Yokoi et al.

(10) Patent No.: US 7,739,904 B2
(45) Date of Patent: Jun. 22, 2010

(54) ABNORMALITY DETECTION APPARATUS AND METHOD FOR OIL LEVEL SENSOR

(75) Inventors: Tatsuhisa Yokoi, Toyota (JP); Yasuo Harada, Toyota (JP); Ryouhei Kusunoki, Toyonaka (JP); Hidetomo Horikawa, Ibaraki (JP); Ryoichi Kitaoka, Ikeda (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 340 days.

(21) Appl. No.: 12/000,176

(22) Filed: Dec. 10, 2007

(65) Prior Publication Data

US 2008/0154477 A1 Jun. 26, 2008

(30) Foreign Application Priority Data

Dec. 22, 2006 (JP) ..... 2006-345816

(51) Int. Cl.
*G01M 15/00* (2006.01)

(52) U.S. Cl. ..... 73/114.56

(58) Field of Classification Search ..... 73/114.55, 73/114.56, 114.57, 114.77, 290 R
See application file for complete search history.

(56) References Cited

U.S. PATENT DOCUMENTS 4,480,610 A * 11/1984 Stinson ..... 123/196 S
4,503,419 A * 3/1985 Kidd et al. ..... 340/450.3
5,019,800 A * 5/1991 Gallert ..... 340/450.3
5,056,622 A * 10/1991 Vermeulen ..... 184/6.4
5,687,687 A * 11/1997 Trueblood et al. ..... 123/196 S
7,498,932 B1 * 3/2009 Steffen ..... 340/450.3
2010/0042310 A1 * 2/2010 Shinogi et al. ..... 701/112

FOREIGN PATENT DOCUMENTS

JP A 03-130519 6/1991
JP A 05-163923 6/1993
JP A-2004-156454 6/2004

OTHER PUBLICATIONS

European Search Report issued Apr. 6, 2010.

* cited by examiner

*Primary Examiner*—Eric S McCall
(74) *Attorney, Agent, or Firm*—Oliff & Berridge PLC

(57) ABSTRACT

An abnormality detection apparatus for detecting an abnormality of an oil level sensor having lower and upper oil level detectors includes: a recording portion that records the output of the upper oil level detector before the internal combustion engine is started; and a determining portion that determines that the upper oil level detector has an abnormality if the output of the lower oil level detector is indicating, after the start of the internal combustion engine, that the oil level is higher than the first reference oil level while the output of the upper oil level detector recorded by the recording portion is indicating that the oil level was lower than the second reference oil level before the start of the internal combustion engine.

15 Claims, 11 Drawing Sheets

ABNORMALITY DETECTION APPARATUS AND METHOD FOR OIL LEVEL SENSOR

INCORPORATION BY REFERENCE

The disclosure of Japanese Patent Application No. JP-2006-345816 filed on Dec. 22, 2006 including the specification, drawings and abstract is incorporated herein by reference in its entirety.

BACKGROUND OF THE INVENTION

1. Field of the Invention

The invention relates to a technology for detecting an abnormality of an oil level sensor that detects the oil level in the oil pan of an internal combustion engine.

2. Description of the Related Art

For example, Japanese Patent Application Publication No. 3-130519 (JP-A-3-130519, Page 5, FIG. 3, FIG. 5) and Japanese Patent Application No. 5-163923 (JP-A-5-163923, Page 3 to 4, FIG. 5) each recite a technology for detecting abnormalities of upper and lower oil level detectors (upper and lower switches) of an oil level sensor that are provided in the oil pan of an internal combustion engine.

In the technologies described in the above publications, based on the premise that a specific combination of the outputs of the two oil level detectors does not last a long time because the oil surface is ruffled as the vehicle runs, it is determined that the oil level detector or portions have an abnormality when a specific combination of the outputs of the two oil level detectors lasts a long time.

With the increasing importance of exhaust purification, devices for purifying exhaust gas, such as catalysts and filters, have been increasingly used. In some internal combustion engines incorporating such an exhaust purification device, fuel is supplied to the exhaust purification device from the combustion chamber side in order to burn and thus remove the particulate matter (PM) accumulated in the exhaust purification device or to promote or continue the catalyst reactions. For example, in some diesel engines, so-called after-injection or post-injections are performed.

When such fuel injection for supplying fuel to an exhaust purification device is performed in each combustion chamber, fuel tends to be mixed into the engine oil through between the cylinder wall and the piston. The more the fuel is mixed into the engine oil, the viscosity of the engine oil decreases, which may result in stuck up due to heat or excessive rising of the oil level in the oil pan, causing a leak of the engine oil (e.g., a leak of the engine oil to the PCV (Positive Crankcase Ventilation) path via which blow-by gas is supplied to each combustion chamber).

As such, in order to promptly detect that fuel has been mixed into the engine oil, an oil level detector is provided at a position higher than the level at which the oil surface normally remains when the internal combustion engine is operating, and if the oil level continues to be above the position of the oil level detector during the operation of the internal combustion engine, it is determined that fuel has already been mixed into the engine oil and thus the engine oil needs to be changed.

However, in a case where the oil level detector is out of order continuing to output a signal indicating that the oil level is lower than the position of the oil level detector, the mixing-in of fuel can not be detected, and therefore problems, such as a decrease in the oil viscosity and excessive rising of the oil level, may occur.

To counter this, one option is to determine that the oil level detector has an abnormality when the oil level detector has continued to produce a specific output for a long time, based on the premise that it is impossible for the oil level detector to continue to produce a specific output for a long time if it is in the normal condition, as in the methods employed in the above-stated publications.

This abnormality detection method, however, takes a long time before detecting an abnormality with precision. If an abnormality can not be detected and no counter-measure for the abnormality is taken for a long time, it allows fuel to be mixed into the engine oil.

SUMMARY OF THE INVENTION

The invention provides a technology that enables early detection of an abnormality of an oil level sensor for detecting the oil level in the oil pan of an internal combustion engine.

An aspect of the invention relates to an abnormality detection apparatus for detecting an abnormality of an oil level sensor having a lower oil level detector adapted to produce an output that changes as the oil level in an oil pan of an internal combustion engine changes across a first reference oil level and an upper oil level detector adapted to produce an output that changes as the oil level in the oil pan changes across a second reference oil level that is higher than the first reference oil level. The first reference oil level and the second reference oil level are set such that the oil level in the oil pan falls between the first reference oil level and the second reference oil level when the internal combustion engine is operating and the oil level in the oil pan is higher than the second reference oil level when the internal combustion engine is not operating. The abnormality detection apparatus includes: pre-engine-start upper-oil-level-detector output recording portion for recording an output of the upper oil level detector before the internal combustion engine is started; and abnormality determining portion for determining that the upper oil level detector has an abnormality if the output of the lower oil level detector is indicating, after the start of the internal combustion engine, that the oil level is higher than the first reference oil level while the output of the upper oil level detector recorded by the pre-engine-start upper-oil-level-detector output recording portion is indicating that the oil level was lower than the second reference oil level before the start of the internal combustion engine.

When the engine oil amount is sufficient and the upper oil level detector is in the normal condition, the output of the upper oil level detector normally indicates that the oil level was higher than the position of the upper oil level detector before the start of the internal combustion engine. Thus, if the lower oil level detector is indicating, after the start of the internal combustion engine, that the oil level is higher than the first reference oil level, that is, if the amount of oil in the internal combustion is sufficient after the start of the internal combustion engine, it is considered that the oil level was equal to or higher than the second reference oil level before the start of the internal combustion engine.

As such, the above-described abnormality detection apparatus can determine that the upper oil level detector has an abnormality if the output of the lower oil level detector is indicating, after the start of the internal combustion engine, that the oil level is higher than the first reference oil level while the output of the upper oil level detector recorded by the pre-engine-start upper-oil-level-detector output recording portion is indicating that the oil level was lower than the second reference oil level before the start of the internal combustion engine.

According to the above-described abnormality detection apparatus, as such, an abnormality can be detected within a short time period across the start of the internal combustion engine. Thus, an abnormality of the oil level sensor for detecting the oil level in the oil pan can be detected in an early stage.

BRIEF DESCRIPTION OF THE DRAWINGS

The foregoing and further objects, features and advantages of the invention will become apparent from the following description of preferred embodiments with reference to the accompanying drawings, wherein like numerals are used to represent like elements and wherein.

DETAILED DESCRIPTION OF EMBODIMENTS

Figure 1:
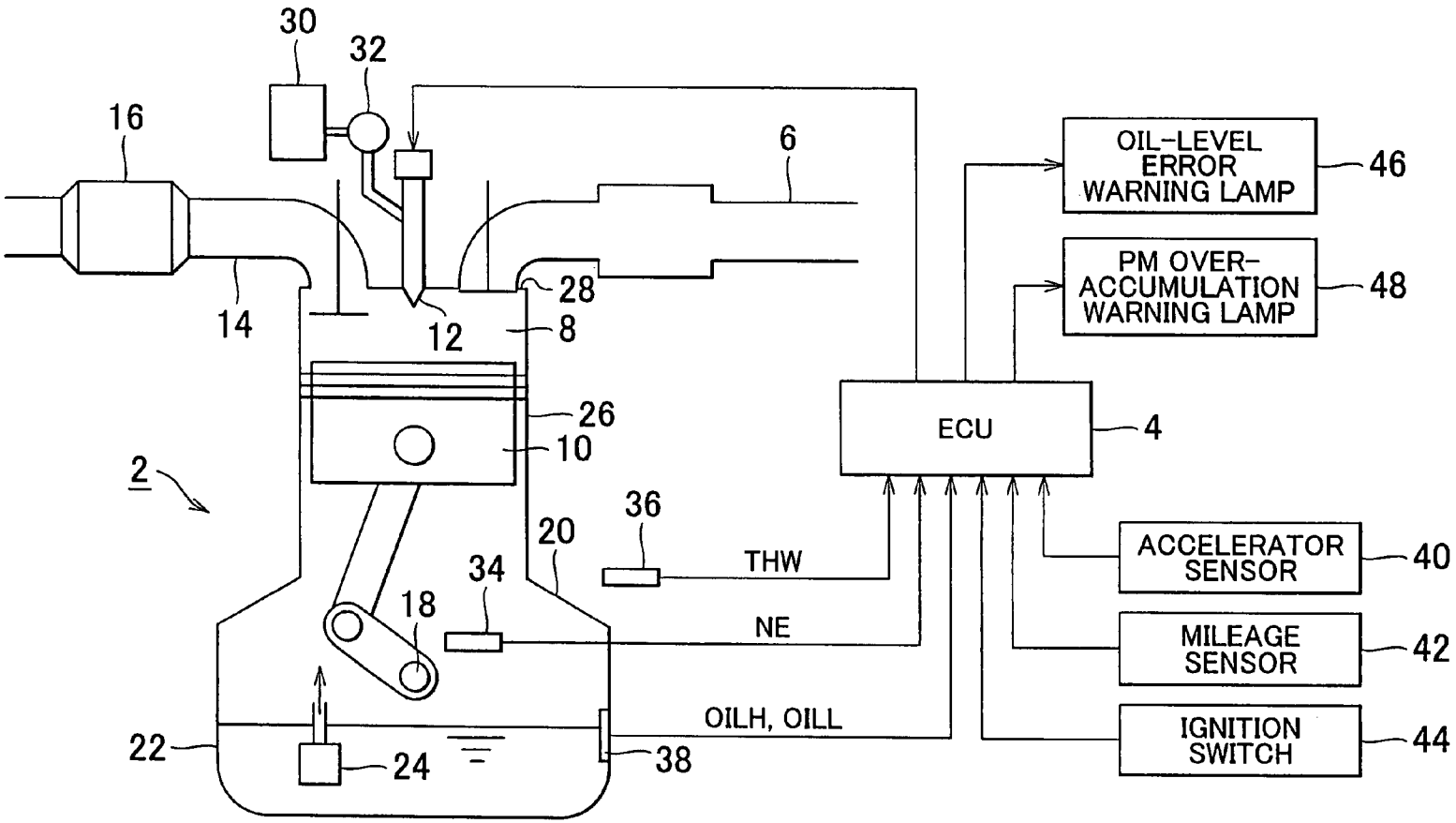
FIG. 1 is a block diagram schematically showing the configuration of a motor vehicle diesel engine incorporating an abnormality detection apparatus according to an example embodiment of the invention.

FIG. 1 is a block diagram schematically showing the configuration of a motor vehicle diesel engine 2 incorporating an abnormality detection apparatus having an electronic control unit (will be referred to as "ECU") 4 that executes various processes.

In the diesel engine 2, air is drawn into each combustion chamber 8 via an intake pipe 6, and fuel is, after compression by a piston 10, injected from a fuel injection valve 12, after which the injected fuel is combusted in the combustion chamber 8. The exhaust gas produced by the fuel combustion is discharged to the outside through an exhaust pipe 14 and a PM filter 16 located in the exhaust pipe 14 for removing particulate matter, which the PM filter 16 corresponds to "exhaust purification device" in the invention. Note that the diesel engine 2 may be a diesel engine provided with a turbocharger, or the like.

The PM filter 16 serves as a so-called DPNR (diesel particulate-NOx reduction system). More specifically, the PM filter 16 is a diesel particulate filter carrying NOx catalyst (NOx storage-reduction catalyst in this example embodiment) and catalyst for oxidizing the particulate matter trapped by the PM filter 16. Alternatively, the PM filter 16 may be a NSR (NOx storage-reduction catalyst), a DPF (diesel particulate filter) containing no NOx catalyst but carrying catalyst for oxidizing the trapped particulate, a CCO (oxidizing catalyst), or the like.

A crankcase 20 in which a crankshaft 18 is arranged and an oil pan 22 storing engine oil are provided at the lower portion of the diesel engine 2. The oil stored in the oil pan 22 is supplied to frictional portions in the diesel engine 2 (e.g., inner surfaces of cylinders 26 defining the combustion chambers 8) and hydraulic components that operate using oil as a working fluid via an oil pump 24 provided inside the oil pan 22. After used to lubricate the frictional portions of the diesel engine 2 and used to drive the hydraulic components, the oil is then returned back to the oil pan 22 via circulation passages formed in the respective portions of the diesel engine 2 and the returned oil is then stored in the oil pan 22.

A common rail 32 is provided in a cylinder head 28 to supply fuel to each fuel injection valve 12. High-pressure fuel is supplied from a supply pump 30 to the common rail 32, and the supplied high-pressure fuel is stored at a high pressure in the common rail 32. Fuel is injected from each fuel injection valve 12 at a time point near the top dead center and the injected fuel is then combusted in the combustion chamber 8. Such regular fuel injections are typically called "main fuel injection". As fuel is thus combusted, the piston 10 is pushed down, whereby torque is output via the crankshaft 18. When the amount of particulate matter accumulated in the PM filter 16 has increased to a certain level, fuel is injected from each fuel injection valve 12 during the time period from the late stage of the power stroke to the exhaust stroke in order to recover the capacity of the PM filter 16. Such fuel injections typically are called "post injection". By the post injection, fuel is supplied into the exhaust gas, so that the particulate matter trapped in the PM filter 16 is combusted and thus removed, whereby the capacity of the PM filter 16 is recovered.

The diesel engine 2 is provided with a rotation speed sensor 34 for detecting a rotation speed of the crankshaft 18, a coolant temperature sensor 36 for detecting a temperature of the coolant of the diesel engine 2, and an oil level sensor 38 for detecting the oil level in the oil pan 22. Further, the diesel engine 2 is provided with an accelerator sensor 40 for detecting the depression of the accelerator pedal, a mileage sensor 42 for detecting the mileage of the vehicle, and so on. The ECU 4 receives the detection signals from these sensors 34 to 42 and the switch signals from an ignition switch 44, etc., and performs various calculations using the received signals.

Further, the ECU 4 indicates the results of the calculations, in particular the results of the later-described abnormality detection processes, by portion of warning lamps 46, 48 provided on the instrument panel in the passenger compartment. Specifically, the oil-level error warning lamp 46 is lit up to inform that it is the time to change the oil, and the PM over-accumulation warning lamp 48 is lit up to inform that the PM filter 16 has an abnormality.

Figure 2:
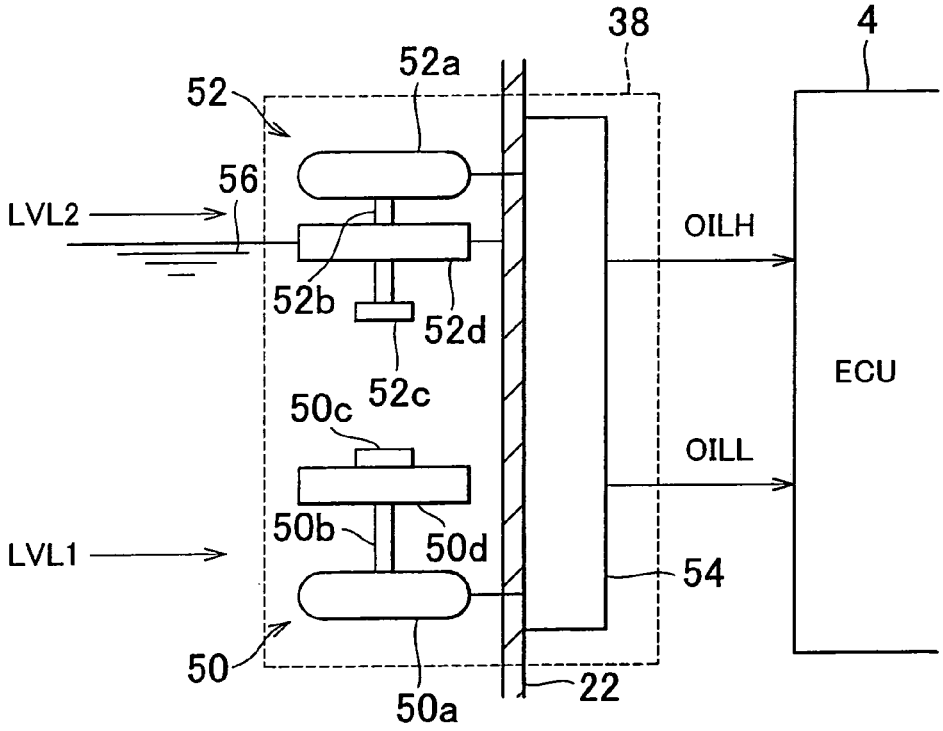
FIG. 2 is a view schematically showing the structure of an oil level sensor of the example embodiment.

Referring to FIG. 2, the oil level sensor 38 has two oil level detectors 50, 52. The oil level sensor 38 is attached to the oil pan 22 via a connector 54. With regard to the two oil level detectors 50, 52, the lower oil level detector 50 outputs an ON signal when the oil level is lower than a first reference oil level LVL1, which is set as a detection boundary, and the lower oil level detector 50 outputs an OFF signal when the oil level is higher than the first reference oil level LVL1. A lower switch 50*a* is provided at the lower side of the lower oil level detector 50, and a float magnet 50*d* is retained by a guide 50*b* that is provided above the lower switch 50*a* and a stopper 50*c*, provided at the upper end of the guide 50*b*. The float magnet 50*d* is formed by combining a float for making the float magnet 50*d* floatable on the oil and a magnet, and the float magnet 50*d* is retained on the guide 50*b* between the lower switch 50*a* at the lower end and the stopper 50*c* at the upper end such that the float magnet 50*d* can move only in the vertical direction.

The upper oil level detector 52 outputs an ON signal when the oil level in the oil pan 22 is higher than a second reference oil level LVL2 that is set as a detection boundary and is higher than the first reference oil level LVL1, and the upper oil level detector 52 outputs an OFF signal when the oil level is lower than the second reference oil level LVL2. The configuration of the upper oil level detector 52 is an upside-down version of that of the lower oil level detector 50. That is, an upper switch 52*a* is provided at the upper side of the upper oil level detector 52, and a float magnet 52*d* is retained by a guide 52*b* that is provided below the upper switch 52*a* and a stopper 52*c* provided at the lower end of the guide 52*b*. The float magnet 52*d* has the same structure as the float magnet 50*d* and thus is floatable on the oil. The float magnet 52*d* is retained on the guide 52*b* between the upper switch 52*a* at the upper end and the stopper 52*c* at the lower end such that the float magnet 52*d* can move only in the vertical direction.

Figure 3:
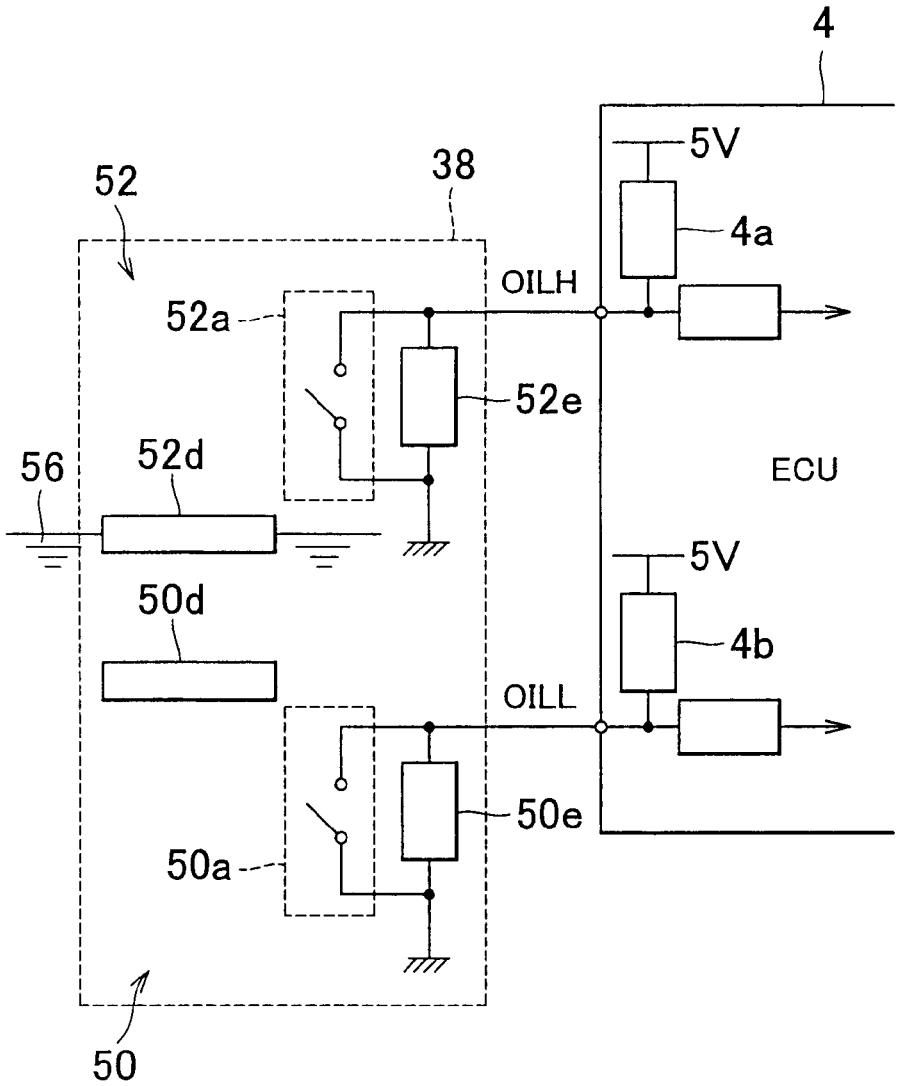
FIG. 3 is a circuit diagram of the oil level sensor of the example embodiment.

The circuit of the oil level sensor 38 is configured as shown in FIG. 3. In the oil level detectors 50, 52, referring to FIG. 3, resistors 50*e*, 52*e* that are provided in parallel with the switches 50*a*, 52*a*, respectively, are both housed in the connector 54, and other components are arranged in the oil pan 22 as shown in FIG. 2. In this example embodiment, the resistances of resistors 4*a*, 4*b* provided immediately after the points to which power is supplied from the ECU 4 are equal to the resistances of the resistors 50*e*, 52*e* (The blank boxes on the circuit shown in FIG. 3 represent resistors).

Referring to FIG. 2 and FIG. 3, when the level of the oil 56 is between the position of the lower oil level detector 50 and the position of the upper oil level detector 52, the switches 50*a*, 52*a* are both turned off, and the oil level detectors 50, 52 both output 2.5 V, the middle between 0 V and 5 V, to the ECU 4.

When the level of the oil 56 is lower than the position of the lower oil level detector 50, that is, when the level of the oil 56 is equal to or lower than the first reference oil level LVL1, the float magnet 50*d* of the lower oil level detector 50 stops at a position where the lower switch 50*a* is turned on. At this time, the float magnet 52*d* of the upper oil level detector 52 is retained on the stopper 52*c* at the lower end and thus the upper switch 52*a* remains off. In this state, therefore, the upper oil level detector 52 outputs 2.5 V to the ECU 4 while the lower oil level detector 50 outputs 0 V to the ECU 4.

Meanwhile, when the level of the oil 56 is higher than the position of the upper oil level detector 52, that is, when the level of the oil 56 is equal to or higher than the second reference oil level LVL2, the float magnet 52*d* of the upper oil level detector 52 stops at a position where the upper switch 52*a* is turned on. At this time, the float magnet 50*d* of the lower oil level detector 50 is retained by the stopper 50*c* and thus the lower switch 50*a* is off. In this state, therefore, the lower oil level detector 50 outputs 2.5V to the ECU 4 while the upper oil level detector 52 outputs 0V to the ECU 4.

When the connection between the connector 54 and the ECU 4 is accidentally disconnected, the oil level detectors 50, 52 both output 5 V to the ECU 4. However, when the connection in the oil pan 22 is accidentally disconnected, the oil level detectors 50, 52 both output 2.5 V to the ECU 4 as they do when their switches 50*a*, 52*a* are off. Thus, the disconnection of the connection in the oil pan 22 can not be detected by referring only to the signals from the oil level detectors 50, 52.

Next, abnormality detection routines that are executed by the ECU 4 will be described with reference to FIG. 4 to FIG. 7. Each routine is repeatedly executed at given time intervals as an interrupt. In the following description, the steps in each flowchart will be abbreviated to "S".

Figure 4:
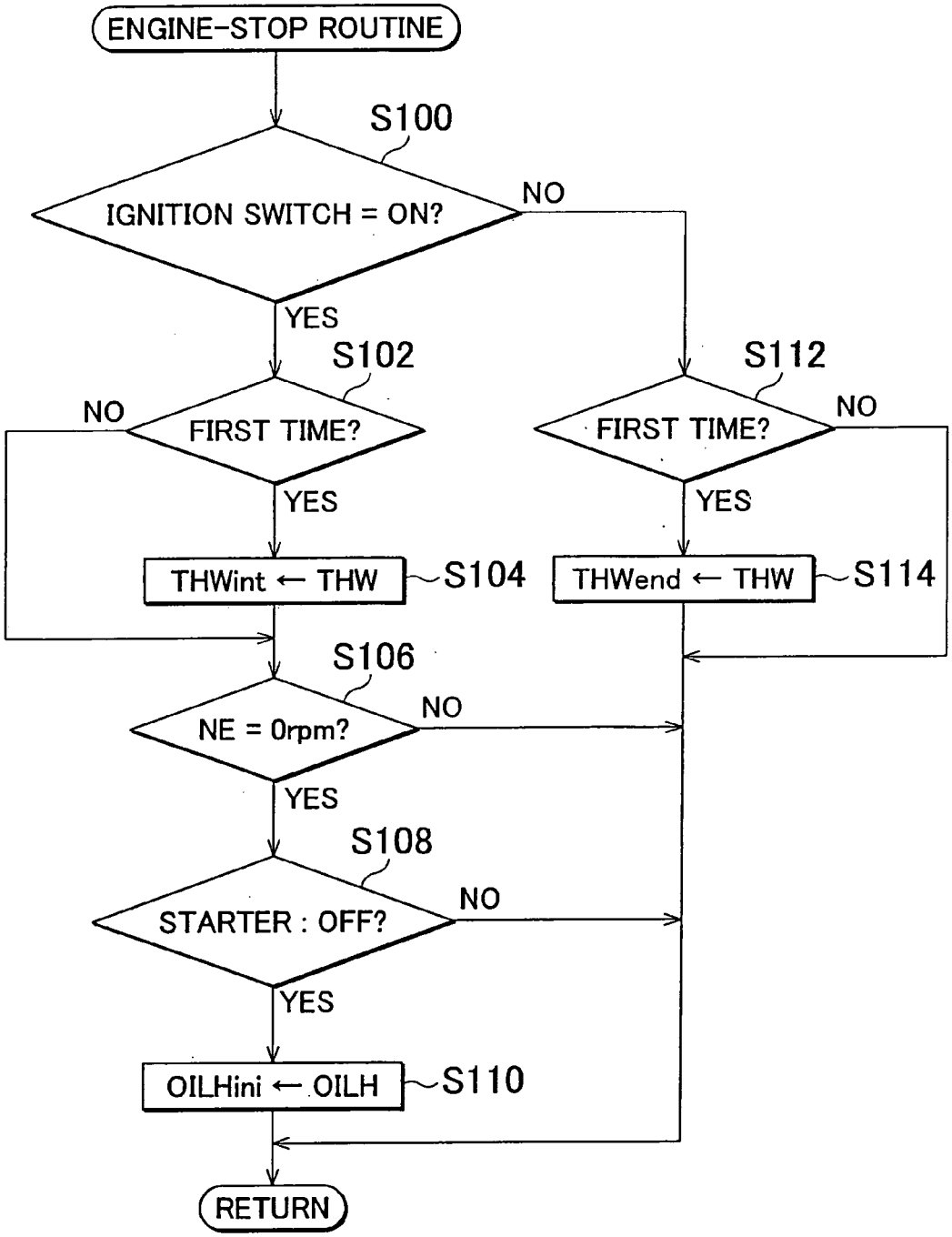
FIG. 4 is a flowchart illustrating an engine-stop routine executed by an ECU of the example embodiment.

First, an engine-stop routine will be described with reference to FIG. 4. In this routine, it is first determined whether an ignition switch 44 is at the ON position (S100). If the ignition switch 44 is at the ON position (S100: YES), it is then determined whether the present cycle is the first cycle after the ignition switch 44 has been turned to the ON position (S102). If so, that is, if the ignition switch 44 has just been turned to the ON position by the driver (S102: YES), the coolant temperature THW presently detected by the coolant temperature sensor 36 is then recorded in the memory of the ECU 4 as an engine-start initial coolant temperature THWint (S104). Note that the engine-start initial coolant temperature THWint may correspond to "second temperature" in the invention.

Next, it is determined whether the engine speed NE presently detected by the rotation speed sensor 34 is 0 rpm (S106), and it is determined whether a starter, not shown in the drawings, is off (S108). If the engine speed NE is 0 rpm (S106: YES) and the starter is off (S108: YES), an output value OILH of the upper switch 52*a* (ON or OFF) is recorded in the memory of the ECU 4 as an upper switch initial value OILHini (S110).

If the ignition switch 44 is presently at the ON position (S100: YES) and the present cycle is the second or later cycle (S102: NO), the routine proceeds to S106 by skipping S104. Further, if the crankshaft 18 is presently rotating (S106: NO), or if the starter has already been activated to start the diesel engine 2 (S108: NO), S110 is skipped.

If the ignition switch 44 is at the OFF position (S100: NO), it is then determined whether the present cycle is the first cycle after the ignition switch 44 has been turned to the OFF position (S112). If so (S112: YES), the coolant temperature THW presently detected by the coolant temperature sensor 36 is then recorded in the memory of the ECU 4 as an engine-off coolant temperature THWend (S114). Note that the engine-off coolant temperature THWend may correspond to "first temperature" in the invention.

Next, an upper-switch disconnection determination routine will be described with reference to FIG. 5. In this routine, it is first determined whether the engine-start initial coolant temperature THWint and the upper switch initial value OILHini were set in the engine-stop routine (FIG. 4) that was executed in response to the ignition switch 44 being turned to the ON position this time, that is, whether S104 and S110 were executed in the engine-stop routine (S200).

If the engine-start initial coolant temperature THWint and the upper switch initial value OILHini were not set (S200: NO), the present cycle of the routine is finished. On the other hand, if the engine-start initial coolant temperature THWini and the upper switch initial value OILHini were set (S200: YES), it is then determined whether the engine speed NE is equal to or higher than a disconnection detection reference rotation speed NEUP (S202). The disconnection detection reference rotation speed NEUP is set to, for example, a rotation speed at which the start-up of the diesel engine (2) can be determined to be complete or to an idling speed. If the engine speed NE has not yet increased sufficiently and thus it is still lower than the disconnection detection reference rotation speed NEUP (S202: NO), the present cycle of the routine is finished.

When the engine speed NE has become equal to or higher than the disconnection detection reference rotation speed NEUP (5202: YES), it is then determined whether the engine-start initial coolant temperature THWint is equal to or lower than a disconnection detection reference coolant temperature THWOILIN (S204). The disconnection detection reference coolant temperature THWOILIN is used to determine whether a sufficient time has passed since the diesel engine 2 is stopped, and this determination as to the passage of time is performed to determine whether a sufficient amount of oil has returned to the oil pan 22 after circulating through the respective portions of the diesel engine 2.

If the engine-start initial coolant temperature THWint is higher than the disconnection detection reference coolant temperature THWOILIN (S204: NO), it indicates that the diesel engine 2 was started again shortly after it was stopped the last time. In this case, the present cycle of the routine is finished. On the other hand, if the engine-start initial coolant temperature THWint is equal to or lower than the disconnection detection reference coolant temperature THWOILIN (S204: YES), a determination is made using the engine-off coolant temperature THWend recorded in S114 in the engine-stop routine (FIG. 4) that was executed when the diesel engine 2 was stopped the last time and the engine-start initial coolant temperature THWint recorded in S104 when the diesel engine 2 was started this time (S206). That is, it is determined whether the value obtained by subtracting the engine-start initial coolant temperature THWint from the engine-off coolant temperature THWend is equal to or larger than a disconnection detection reference temperature difference THWTRDL (S206). If it is equal to or larger than the disconnection detection reference temperature difference THETRDL, it indicates that, at the time the diesel engine 2 was started this time, the coolant temperature THW had already sufficiently decreased from that when the diesel engine 2 was stopped the last time, that is, it indicates that the diesel engine 2 had been stopped for a sufficiently long time. Thus, by executing S204 and S206, it is determined whether the time period for which the diesel engine 2 was off is long enough to execute processes for detecting an accidental disconnection of the upper switch 52*a*.

If "YES" is obtained in S206, it is then determined whether an output value OILL of the lower switch 50*a* is OFF (S208). Then, it is determined whether the output value OILL has continuously been OFF (S208: YES) for a determination allowance time period or longer (S210). These two determinations (S208, S210) are performed also after the start of the diesel engine 2 to determine whether the oil level is stable above the position of the lower switch 50*a* in the oil pan 22. If "YES" is obtained in S210, it is estimated that, at the time immediately before the diesel engine 2 was started this time, the oil level in the oil pan 22 was high enough to turn the upper switch 52*a* on, regardless whether the oil is diluted.

Each time "NO" is obtained in S210, the routine is finished. If the output value OILL of the lower switch 50*a* becomes ON (S208: NO) while "NO" is repeatedly obtained in S210, it is determined that the present state is not appropriate to determine whether the upper switch 52*a* has been accidentally disconnected. Therefore, a disconnection detection counter UPDC is cleared (S218), and a disconnection lamp turning-on flag is set to "OFF" (S220), after which the present cycle of the routine is finished. This flag is referenced in a warning lamp turning-on routine shown in FIG. 7, as will be described later. The values of parameters, which include the flags and counters, are recorded in a nonvolatile memory of the ECU 4.

When it is determined that the output value OILL has continuously been OFF for the determination allowance time period or longer (S210: YES), it is then determined whether the upper switch initial value OILHini recorded in S110 of the engine-stop routine (FIG. 4) is OFF (S212). As mentioned earlier, when "YES" is obtained in S210, it is considered that the oil level in the oil pan 22 was equal to or higher than the position of the upper switch 52*a*, that is, it was equal to or higher than the second reference oil level LVL2 when the diesel engine 2 was stopped the last time. As such, if the upper switch initial value OILHini is ON (S212: NO), it indicates that any accidental disconnection of the upper switch 52*a* has not occurred, and the routine therefore proceeds to S218.

On the other hand, if the upper switch initial value OILHini is OFF (S212: YES), it is considered that this OFF signal is output because the upper switch 52*a* has been accidentally disconnected, that is, a connection failure has occurred. Thus, if "YES" is obtained in S212, it is then determined whether "YES" has been obtained in S212 for the first time in the present, trip (S213), where the word "trip" represent a time during the vehicle switch is on, that is, since the engine has started until the engine is stopped. If so (S213: YES), a disconnection detection counter UPDC is advanced (S214). Because the disconnection detection counter UPDC can be advanced only once in each trip, if the "YES" determination in S212 is the second or later "YES" determination in the present trip (S213: NO), the present cycle of the routine is finished.

After S214, it is determined whether the count of the disconnection detection counter UPDC advanced as mentioned above is smaller than a determination reference number (S216). The determination reference number may be set to one or to two or more. When it is set to two or more, the determination accuracy improves accordingly.

If the count of the disconnection detection counter UPDC is smaller than the determination reference number (S216: YES), it indicates that it is too early to execute processes for addressing the abnormality, that is, the accidental disconnection of the upper switch 52*a*, and therefore the present cycle of the routine is finished. When the disconnection detection counter UPDC reaches the determination reference number while the state where the routine reaches S214 continues in the subsequent trips (S216: NO), the disconnection lamp turning-on flag is set to "ON" (S217), after which the present cycle of the routine is finished.

Figure 5:
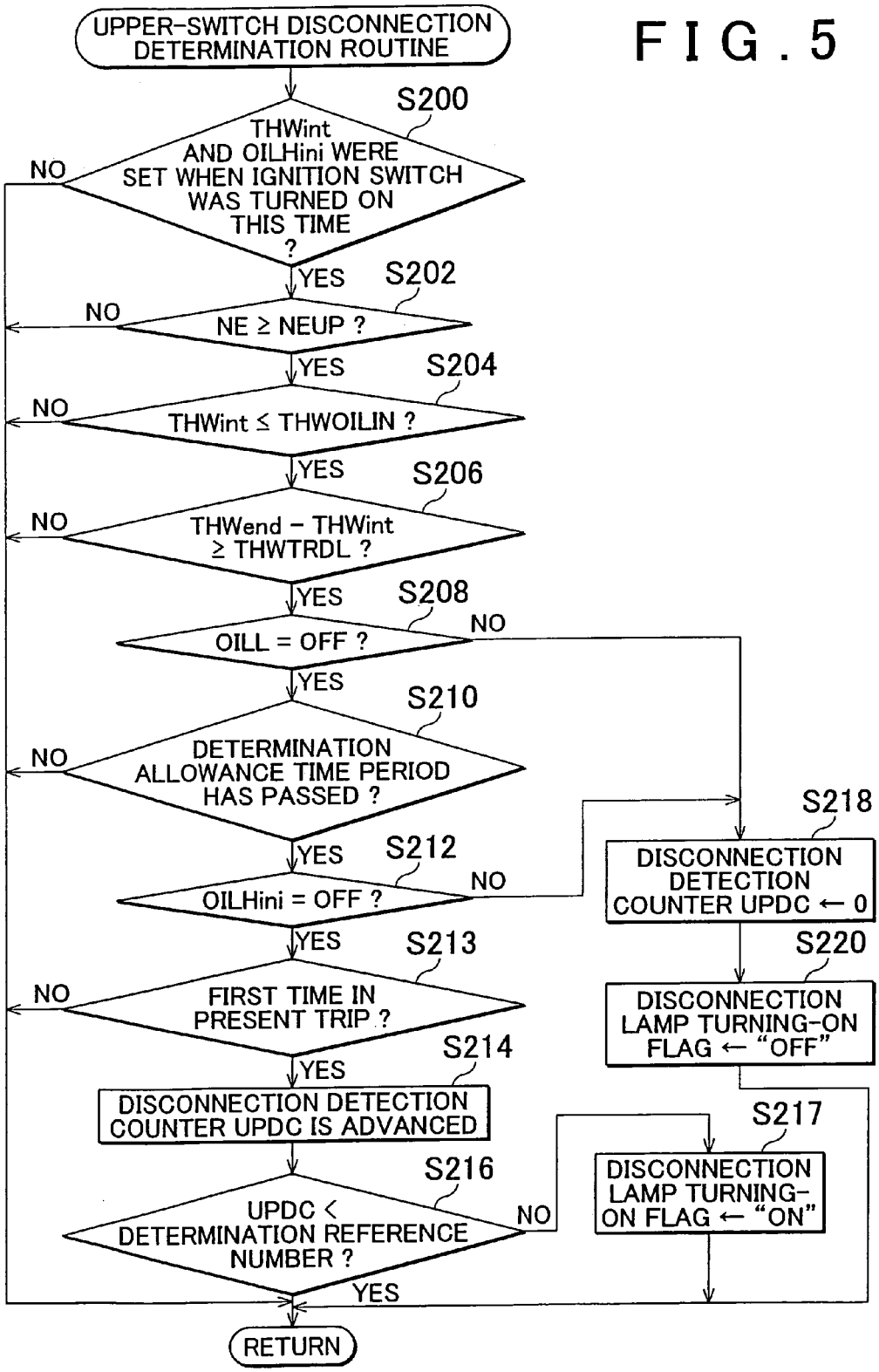
FIG. 5 is a flowchart illustrating an upper-switch disconnection determination routine executed by the ECU of the example embodiment.

As such, in the upper switch disconnection determination routine shown in FIG. 5, the disconnection lamp turning-on flag that will be referenced to determine whether to lit up the oil-level error warning lamp 46 is set based on the output value OILL of the lower switch 50*a* and the output value OILH of the upper switch 52*a*.

Next, an oil-dilution determination routine will be described with reference to FIG. 6. The oil-dilution determination routine is executed based on the output of the upper switch 52*a*, which is also referenced in the upper-switch disconnection determination routine (FIG. 5) as described above. The oil-dilution determination routine is repeatedly executed, as an interrupt, at the same time intervals as the routines illustrated in FIG. 4 and FIG. 5.

In this routine, it is first determined whether the oil-level error warning lamp 46 is presently off (S300). If the oil-level error warning lamp 46 is presently on (S300: NO), the present cycle of the routine is finished. For example, "NO" is obtained in S300 when at least one of an oil-dilution lamp turning-on flag and the disconnection lamp turning-on flag is "ON", and "YES" is obtained in S300 when the oil-dilution lamp turning-on flag and the disconnection lamp turning-on flag are both "OFF".

If the oil-level error warning lamp 46 is off (S300: YES), it is then determined whether the coolant temperature THW presently detected by the coolant temperature sensor 36 is higher than an oil-level detection reference coolant temperature THWx (S302). If the present coolant temperature THW is higher than the oil-level detection reference coolant temperature THWx (S302: YES), it is then determined whether the engine speed NE presently detected by the rotation speed sensor 34 is within an oil-level detection reference range (NEx to NEy) (S304). If "NO" is obtained in either of S302 and S304, the present cycle of the routine is finished.

If the present coolant temperature THW is higher than the oil-level detection reference coolant temperature THWx (S302: YES) and the engine speed NE is within the oil-level detection reference range (NEx<NE<NEy) (S304: YES), it is then determined whether the state where the oil level detection conditions of S302 and S304 have been continuously satisfied longer than a reference time period Cx (S306). If the oil level detection conditions of S302 and S304 have not yet been satisfied longer than the reference time period Cx (S306: NO), the present cycle of the routine is finished.

When it is determined that the oil level detecting conditions of S302 and S304 have already been satisfied longer than the reference time period Cx (S306: YES), it is then determined whether the present output value OILH of the upper switch 52*a* is ON (S308). Note that the fact that the oil level detection conditions of S302 and S304 have continuously been satisfied longer than the reference time period Cx indicates that the oil has been sufficiently distributed from the oil pan 22 to the respective portions of the diesel engine 2. The position of the oil level sensor 38 in a normal state is set such that the oil level falls between the position of the lower switch 50*a* and the position of the upper switch 52*a* when the oil has been sufficiently distributed to the respective portions of the diesel engine 2 unless the oil is not diluted. That is, the output value OILH is OFF in the normal state when the oil is not diluted.

As such, if the output value OILH is OFF (S308: NO), it is then determined whether the time period for which the output value OILH has continuously been OFF is longer than a reference time period Cz (S320). If equal to or shorter than the reference time period Cz (S320: NO), the present cycle of the routine is finished. If longer than the reference time period Cz (S320: YES), conversely, the oil-dilution lamp turning-on flag and a previous-trip oil-change flag are set to "OFF" (S322), where the word "trip" represent a time during the vehicle switch is on, that is, since the engine has started until the engine is stopped, after which the present cycle of the routine is finished.

On the other hand, if the output value OILH is ON (S308: YES), it is then determined whether the time period for which the output value OILH has continuously been ON is longer than a reference time period Cy (S310). If equal to or shorter than the reference time period Cy (S310: NO), the present cycle of the routine is finished. On the other hand, if longer than the reference time period Cy (S310: YES), it is then determined whether "YES" has been obtained in S310 for the first time in the present trip (S312). If not (S312: NO), the present cycle of the routine is finished. If so (S312: YES), conversely, it is then determined whether the previous-trip oil-change flag is "ON" (S314). If not (S314: NO), the previous-trip oil-change flag is set to "ON" (S318), after which the present cycle of the routine is finished.

Conversely, if the previous-trip oil-change flag is "ON" (S314; YES), the oil-dilution lamp turning-on flag is set to "ON" (S316), after which the present cycle of the routine is finished. As such, in the oil-dilution determination routine shown in FIG. 6, the oil-dilution lamp turning-on flag, which will be referenced to determine whether to lit up the oil-level error warning lamp 46, is set based on the output value OILH of the upper switch 52*a*.

Next, a warning lamp turning-on routine will be described with reference to FIG. 7. The warning lamp turning-on routine is executed based on the states of the disconnection lamp turning-on flag and the oil-dilution lamp turning-on flag. The warning lamp turning-on routine is repeatedly executed, as an interrupt, at the same time intervals as the foregoing routines.

Figure 7:
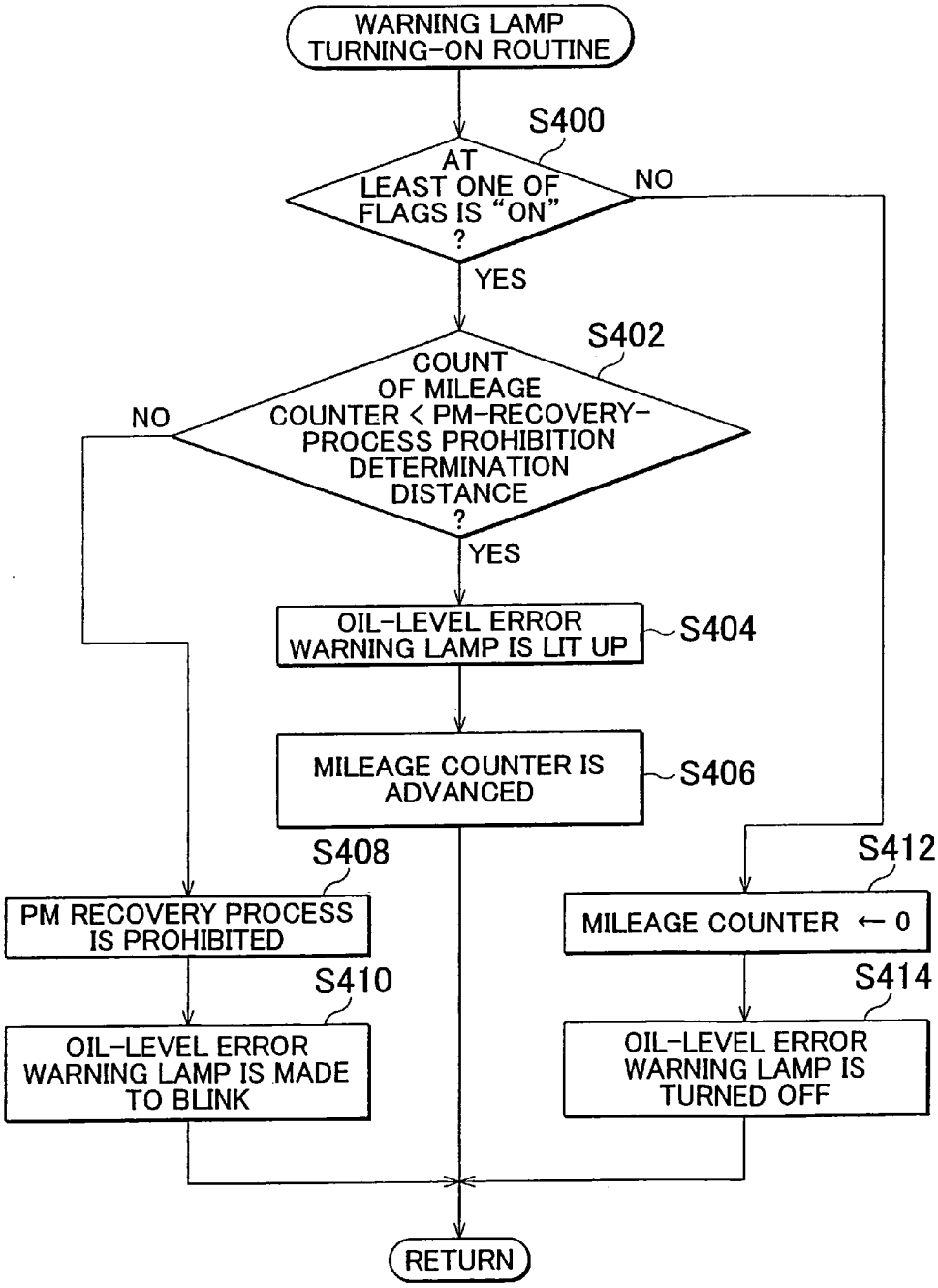
FIG. 7 is a flowchart illustrating a warning lamp turning-on routine executed by the ECU of the example embodiment.

In the warning lamp turning-on routine shown in FIG. 7, it is first determined whether at least one of the disconnection lamp turning-on flag and the oil-dilution lamp turning-on flag is "ON" (S400). If the disconnection lamp turning-on flag and the oil-dilution lamp turning-on flag are both "OFF" (S400: NO), a mileage counter is cleared (S412) and the oil-level error warning lamp 46 is turned off (S414), after which the present cycle of the routine is finished.

Conversely, if at least one of the disconnection lamp turning-on flag and the oil-dilution lamp turning-on flag is "ON" (S400: YES), it is then determined whether the count of the mileage counter is smaller than a PM-recovery-process prohibition determination distance (S402). As will be described later, the mileage counter counts the mileage of the vehicle incorporating the diesel engine 2. If the count of the mileage counter is smaller than the PM-recovery-process prohibition determination distance (S402: YES), the oil-level error warning lamp 46 is lit up (S404). Then, the mileage counter is advanced by an amount corresponding to the distance the vehicle has newly traveled (S406). That is, the mileage counter records the distance that the vehicle travels as long as "YES" is continuously obtained in S400. After S406, the present cycle of the routine is finished.

When the count of the mileage counter reaches the PM-recovery-process prohibition determination distance after "YES" has been continuously obtained in S400 (S402: NO), it is determined that the oil has continuously been diluted or the upper switch 52*a*, which is used for detecting dilution of the oil, has continuously been in an accidentally disconnected state, and therefore execution of the foregoing process for recovering the capacity of the PM filter 16 is prohibited (S408). To inform the driver of this, then, the oil-level error warning lamp 46 is made to blink (S410), after which the present cycle of the routine is finished.

Meanwhile, it is often the case that pressure sensors are provided upstream and downstream of the PM filter 16, respectively, and whether the amount of particulate matter accumulated in the PM filter 16 has exceeded an allowable level and/or whether the PM filter 16 has been damaged are determined using the signals from the pressure sensors. When an abnormality has been detected through such determination processes, a PM over-accumulation lamp 48 is lit up, and/or the fuel injection amount that is set according to the accelerator operation amount is limited as needed.

Figure 8:
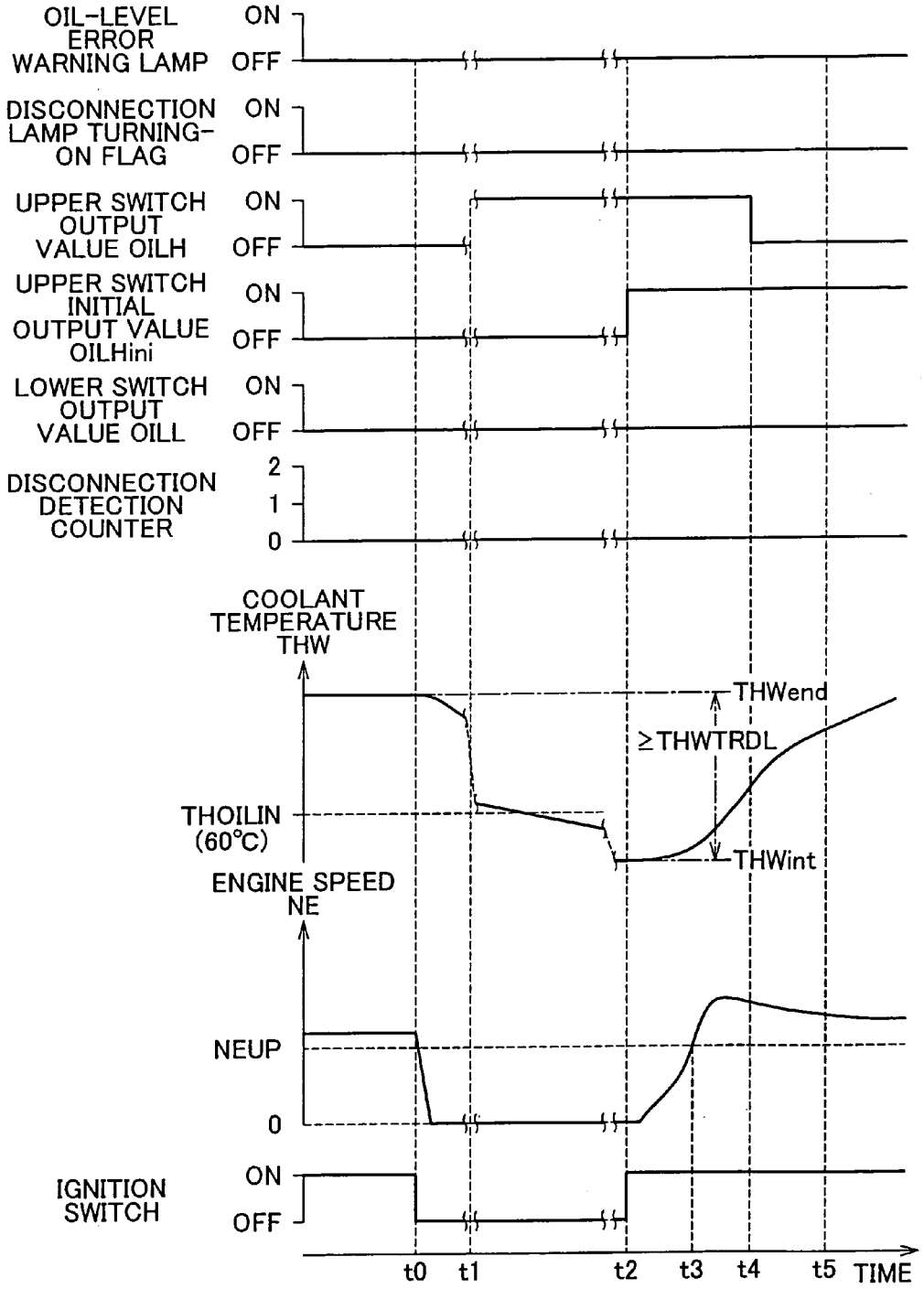
FIG. 8 is a timing chart illustrating an example of the control executed in the example embodiment.

The timing charts of FIG. 8 to FIG. 11 illustrate example cases of the control executed in this example embodiment. FIG. 8 illustrates an example case where the upper switch 52*a* is operating normally. In this example case, referring to FIG. 8, the ignition switch 44 is turned to the OFF position at time t0 and to the ON position at time t2. During this engine-off time period, the output value OILH of the upper switch 52*a* changes from OFF to ON because the oil level rises after the diesel engine 2 stops (t1). Therefore, in the upper-switch disconnection determination routine shown in FIG. 5, "NO" is obtained in S212 that is executed the determination allowance time period after time t3 at which "YES" was obtained in S208, and S218 and S220 are thereafter executed, whereby the disconnection lamp turning-on flag remains "OFF" (S220). At this time, if the oil-dilution lamp turning-on flag was set to "OFF" in the oil-dilution determination routine shown in FIG. 6, "NO" is obtained in S400 of the warning lamp turning-off routine shown in FIG. 7, whereby the oil-level error warning lamp 46 remains off (S414). Note that, in the case illustrated in FIG. 8, the oil level in the oil pan 22 becomes lower than the position of the upper switch 52*a* and thus the output value OILH of the upper switch 52*a* changes from ON to OFF at time t4 after the engine start.

Figure 9:
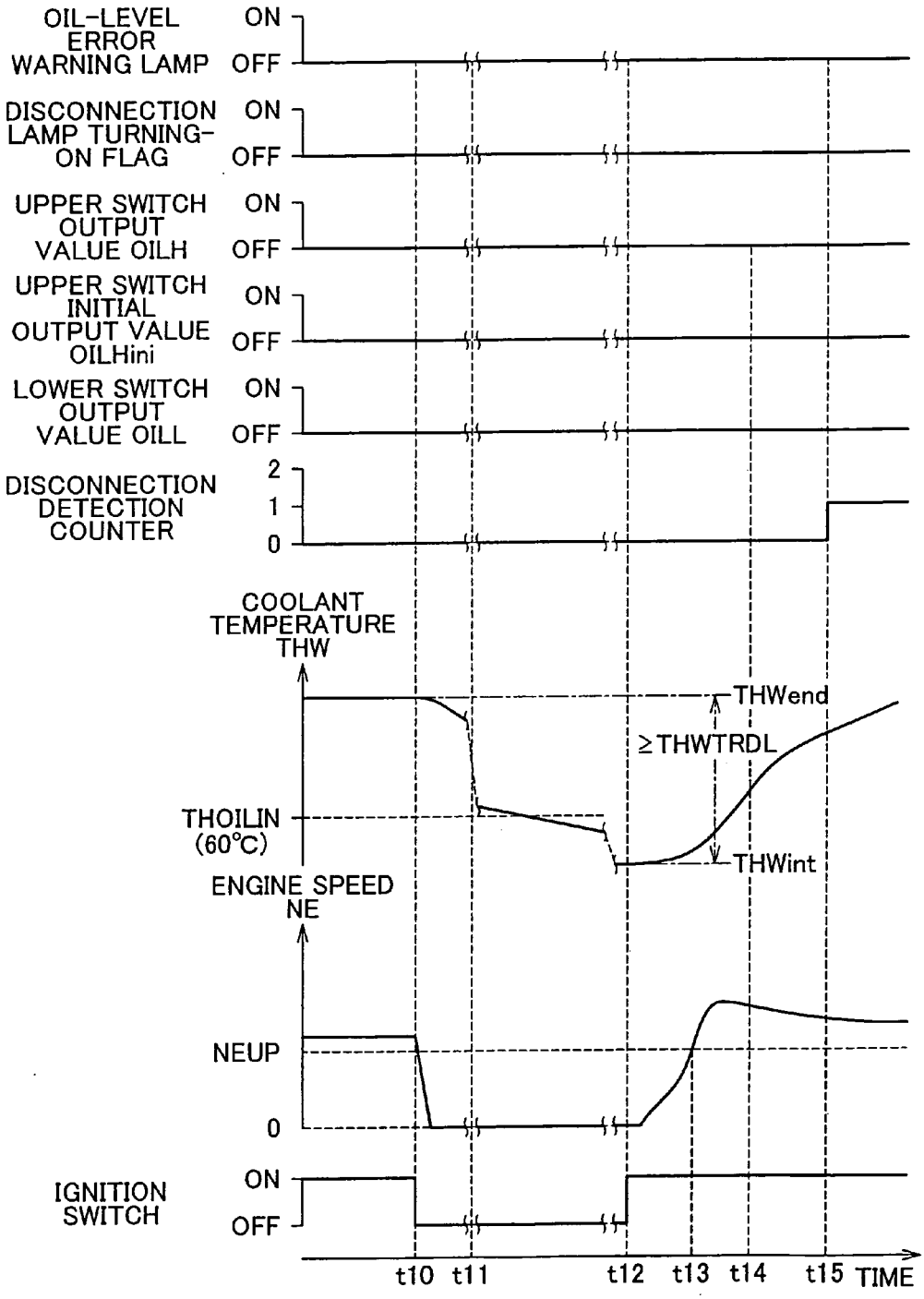
FIG. 9 is a timing chart illustrating another example of the control executed in the example embodiment.

FIG. 9 illustrates an example case in which an accidental disconnection of the upper switch 52*a* occurs. In this example case, referring to FIG. 9, the ignition switch 44 is turned to the OFF position at time t10 and to the ON position time t12. During this engine-off time period, however, because the upper switch 52*a* is in an accidentally disconnected state, the output value OILH remains OFF even when the oil level rises to or beyond the position of the upper switch 52*a*. Therefore, in the upper-switch disconnection determination routine shown in FIG. 5, "YES" is obtained in S212 at t15 that is executed the determination allowance time period after time t13 at which "YES" was obtained in S208, and then "YES" is obtained in S213, so that the disconnection detection counter UPDC is advanced (S214). However, because the present cycle is the first cycle executed after the accidental disconnection of the upper switch 52*a* occurred (S216: YES), the disconnection lamp turning-on flag is still "OFF". Thus, if the oil-dilution lamp turning-on flag has been set to "OFF" in the oil-dilution determination routine shown in FIG. 6, "NO" is obtained in S400 of the warning lamp turning-on routine shown in FIG. 7, and therefore the oil-level error warning lamp 46 remains off (S414). In this example, the oil level in the oil pan 22 becomes lower than the position of the upper switch 52*a* at time t14 after the engine start. However, because the upper switch 52*a* is in an accidentally disconnected state at this time, the output value OILH remains OFF.

Figure 10:
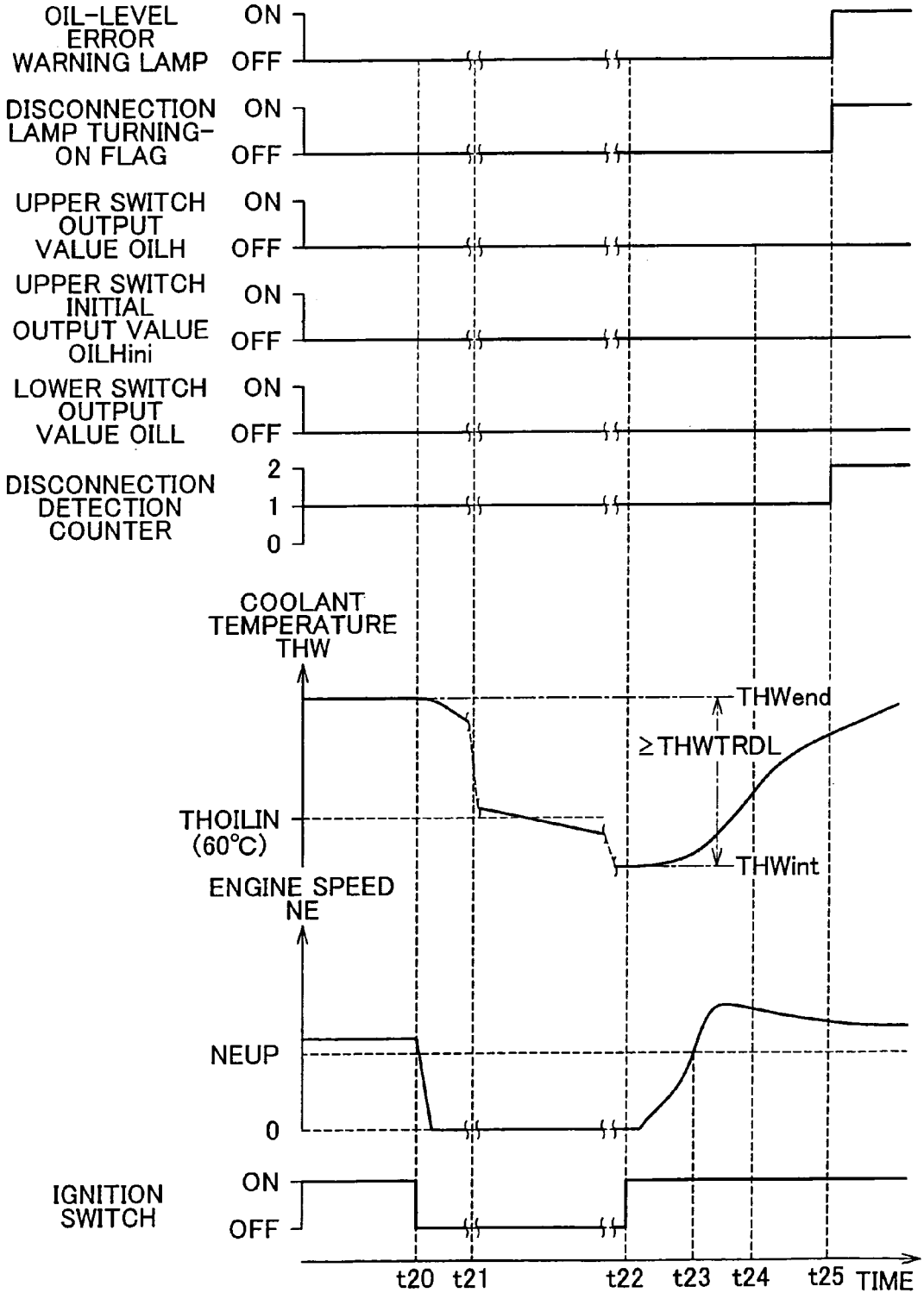
FIG. 10 is a timing chart illustrating another example of the control executed in the example embodiment.

FIG. 10 illustrates an example case where the upper switch 52*a* remains in the accidentally disconnected state in a trip following the trip illustrated in FIG. 9. In this example case, referring to FIG. 10, the ignition switch 44 is turned to the OFF position at time t20 and to the ON position at time t22. During this engine-off time period, however, because the upper switch 52*a* is in the accidentally disconnected state, the output value OILH remains OFF even if the oil level rises to or beyond the position of the upper switch 52*a* (t21). Therefore, in the upper-switch disconnection determination routine shown in FIG. 5, "YES" is obtained in S212 at t25 that is executed the determination allowance time period after time t23 at which "YES" was obtained in S208, and then "YES" is obtained in S213, so that the disconnection detection counter UPDC is advanced (S214). Assuming that the determination reference number is set to 1 in this example embodiment, because the present cycle is the second cycle after the accidental disconnection of the upper switch 52*a* occurred (S216: NO), the disconnection lamp turning-on flag is set to "ON" (S217). In response to this, "YES" is obtained in S400 regardless of the state of the oil-dilution lamp turning-on flag that was set in the oil-dilution determination routine shown in FIG. 7 as described above. Because "YES" is initially obtained in S402, the oil-level error warning lamp 46 is lit up (S404). Although the oil level in the oil pan 22 becomes lower than the position of the upper switch 52*a* at time t24 after the engine start, the output value OILH of the upper switch 52*a* remains OFF because the upper oil level detector 52 is in the accidentally disconnected state.

Figure 11:
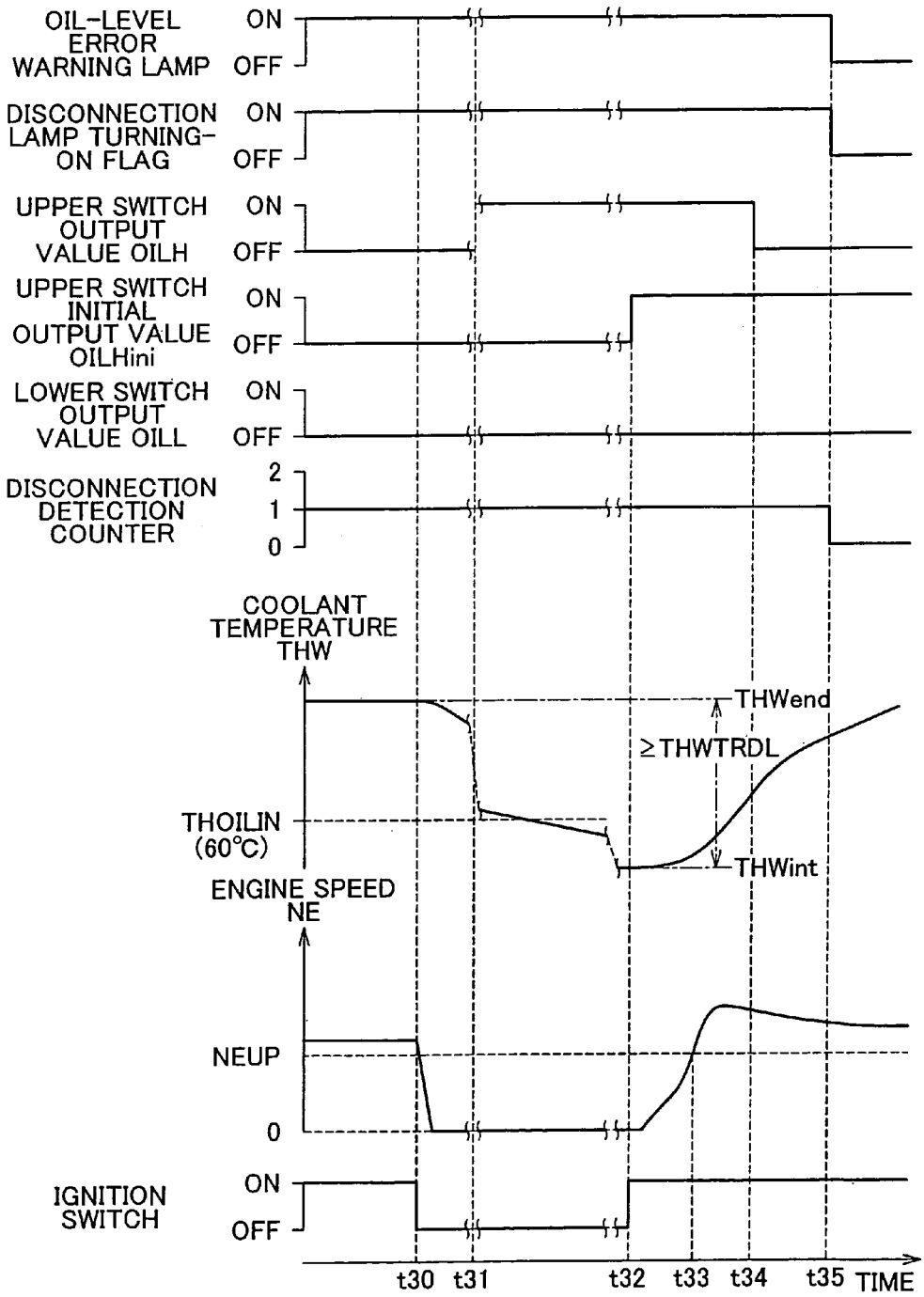
FIG. 11 is a timing chart illustrating another example of the control executed in the example embodiment.

FIG. 11 illustrates an example case where the upper switch 52*a* returns to normal in a trip following the trip illustrated in FIG. 9. In this example case, referring to FIG. 11, the ignition-switch 44 is turned to the OFF position at time t30 and to the ON position at time t32. During this engine-off time period, if the oil level in the oil pan 22 rises to or beyond the position of the upper switch 52*a* (t31), the upper switch 52*a* normally operates and therefore its output value OILH changes from OFF to ON. In response to this, in the upper-switch disconnection determination routine shown in FIG. 5, "NO" is obtained in S212 at t35 that is executed the determination allowance time period after t33 at which "YES" was obtained in S208, and therefore the disconnection detection counter UPDC is cleared (S218) and the disconnection lamp turning-on flag is returned to "OFF" (S220). Thus, at this time, if the oil-dilution lamp tuning-on flag was set to "OFF" in the oil-dilution determination routine shown in FIG. 6, "NO" is obtained in S400 of the warning lamp turning-on routine shown in FIG. 7, so that the oil-level error warning lamp 46 is turned off (S414). Note that the output value OILH of the upper switch 52*a* changes back to OFF because the oil level of the oil pan 22 becomes lower than the position of the upper switch 52*a* at time t34 after the engine start.

Hereafter, the relations between the elements of the foregoing example embodiment and those of the invention will be briefly explained. Among the routines executed by the ECU 4, the engine-stop routine shown in FIG. 4 may be regarded as example processes executed by "pre-engine-start upper-level detector output recording portion" and "engine-stop-time-period determining portion", and the upper-switch disconnection determining routine shown in FIG. 5 may be regarded as example processes executed by "engine-stop-time-period determining portion", "abnormality determining portion", and "abnormality addressing portion". S102, S104, S112, and S114 of the engine-stop routine shown in FIG. 4 and S204 and S206 of the upper-switch disconnection determination routine shown in FIG. 5 may be regarded as example processes executed by the "engine-stop-time-period determining portion". Among these steps, more specifically, S102, S104, S112, and S114 may be regarded as example processes executed by "engine-off temperature recording portion". S214, S216, and S217 of the upper-switch disconnection determination routine shown in FIG. 5 and all the steps of the warning lamp turning-on routine shown in FIG. 7 may be regarded as example processes executed by the "abnormality addressing portion". Among these steps, more specifically, S404 to S410 may be regarded as example abnormality addressing processes.

The foregoing example embodiment provides the following advantages.

(First Advantage)

When the upper switch 52*a* has not been accidentally disconnected and the oil amount is sufficient, the oil level is equal to or lower than the position of the upper switch 52*a* before the engine start, and therefore the output value OILH is normally ON. Therefore, if the output value OILL of the lower oil level detector 50 is OFF after the engine start (S208: YES), that is, if the upper switch initial value OILHini indicating the state of the upper switch 52*a* before the engine start is OFF (S212: YES) despite the fact that the overall oil amount is sufficient, the upper switch 52*a* can be determined to have been accidentally disconnected.

Thus, this abnormality can be detected within a short time period across the start of the diesel engine 2. That is, the abnormality of the oil level sensor 38, which is provided to detect the oil level in the oil pan 22, can be detected in an early stage.

(Second Advantage)

The upper switch initial value OILHini is obtained (S110) in a state where the ignition switch 44 is at the ON position (S100: YES) and the crankshaft 18 of the diesel engine 2 is not rotating (S106: YES, S108: YES) before the engine start.

In this state, a sufficient amount of oil has returned to the oil pan 22 and the oil surface is almost still, and therefore the oil level can be detected with a high precision, so that the determination accuracy improves accordingly.

(Third Advantage)

In a case where the diesel engine 2 has been restarted shortly after the diesel engine 2 was stopped, the oil that has already returned to the oil pan 22 from the respective portions of the diesel engine 2 is not sufficient, and therefore the oil level in the oil pan 22 may still be less than or much less than the maximum oil level. Therefore, the respective determination processes are executed based on the oil level detected from the upper switch initial value OILHini when it is determined that the time period for which the diesel engine 2 was off after it was stopped the last time is longer than a reference time period (S204: YES, S206: YES).

In particular, in the foregoing example embodiment, because the engine-off time period is obtained by estimating it based on the decrease in the temperature of the diesel engine 2, rather than measuring it directly, whether the engine-off time period is longer than the reference time period can be determined without making the system structure complex. In particular, in the foregoing example embodiment, because whether the engine-off time period is longer than the reference time period is estimated by executing S204 and S206 in combination, the estimation accuracy further improves.

As such, in the foregoing example embodiment, because the value of the upper switch initial value OILHini that is obtained when the oil level is at or close to the maximum level is used as the determination reference, the determination accuracy further improves.

(Fourth Advantage)

In the foregoing example embodiment, the abnormality addressing processes, that is, the processes for lighting the oil-level error warning lamp 46 on are not executed in response to an abnormality being detected only once (S212, S213: YES). That is, the disconnection lamp turning-on flag is set to "ON" (S217) in response to an abnormality being detected twice or more in a row (twice in the foregoing example embodiment) (S216: NO), and the abnormality addressing processes (S404-S410) are executed. Thus, the abnormality processes can be performed more appropriately.

(Fifth Advantage)

Figure 6:
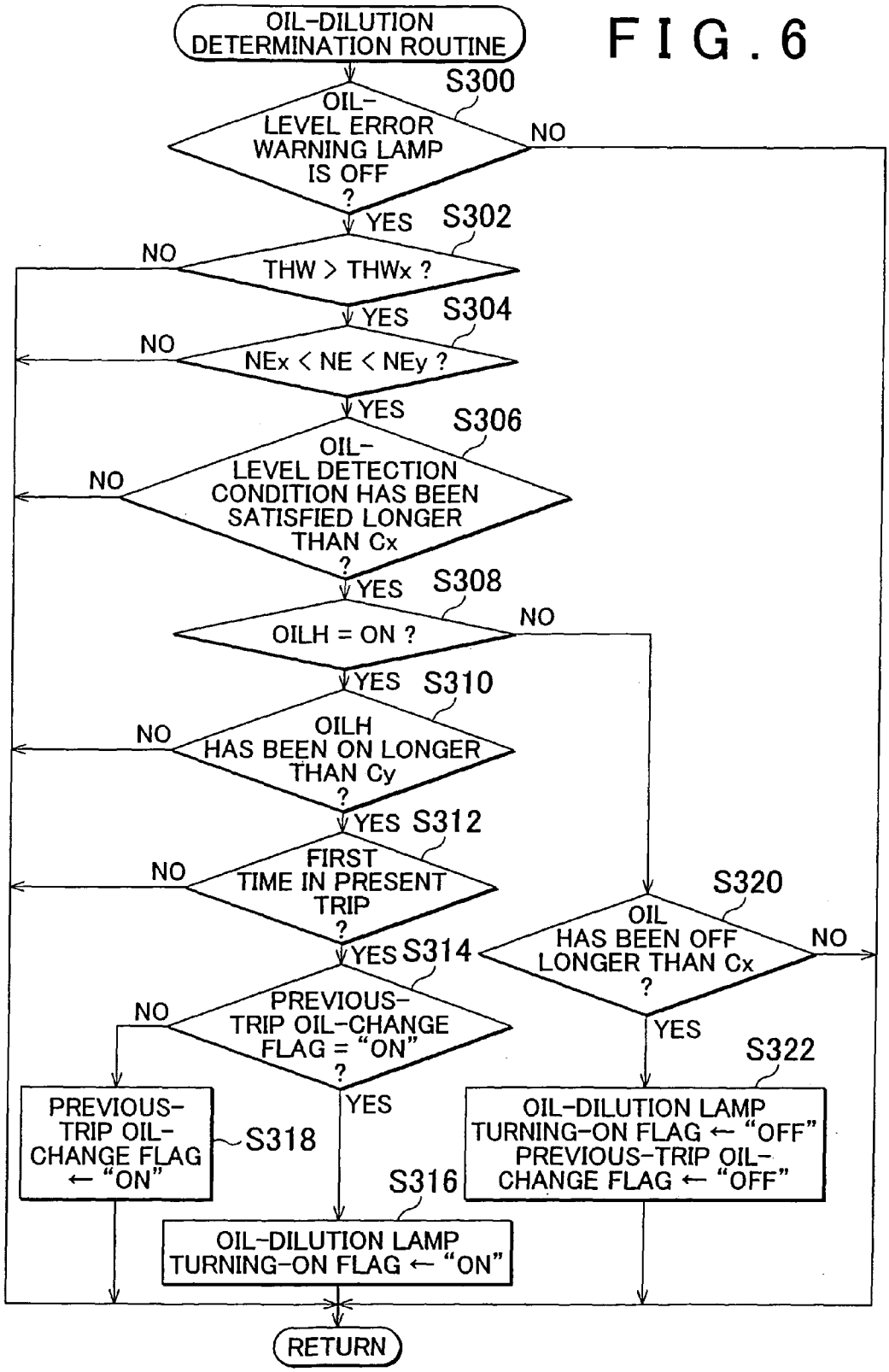
FIG. 6 is a flowchart illustrating an oil-dilution determination routine executed by the ECU of the example embodiment.

In the foregoing example embodiment, because the oil-dilution determination routine shown in FIG. 6 is executed based on the output value OILH of the upper switch 52*a* for which the foregoing disconnection detection processes are continuously performed, an abnormality of the oil level sensor 38, which plays an important roll for the oil dilution determination, can be detected in an early stage and thus the abnormality can be addressed promptly. Thus, it is possible to prevent a decrease in the viscosity of the oil and excessive rising of the oil level in the oil pan 22, which may otherwise be caused by fuel being mixed into the oil.

(Sixth Advantage)

The diesel engine 2 incorporating the oil level sensor 38 is an engine in which fuel injection for heating the PM filter 16 (post injection) is performed. In such diesel engines, fuel tends to be mixed into the oil, and therefore a decrease in the oil viscosity and excessive rising of the oil level are relatively likely to occur. However, because an abnormality of the oil level sensor 38 can be detected in an early stage and the abnormality can therefore be addressed promptly and effectively, a decrease in the oil viscosity and excessive rising of the oil level can be prevented more effectively.

Other Example Embodiments

Other example embodiments of the invention will be described below. Note that in the following description only the differences from the foregoing example embodiment will be described. Therefore, the structures and effects of each example embodiment that are the same as those of the foregoing example embodiment will not be described again.

(a) While the engine-off time period is estimated based on a decrease in the coolant temperature THW in the foregoing example embodiment, the temperature of the diesel engine 2 may be obtained using various other methods based on the decrease in the oil temperature. Further, the engine-off time period may be actually detected as the time period from the ignition switch 44 being turned to the OFF position to the ignition switch 44 being turned to the ON position, which may be measured by providing a timer powered by a back-up power supply in the ECU 4.

(b) While the oil-level error warning lamp 46 is lit up or made to blink in response to an accidental disconnection of the upper switch 52*a* or dilution of the oil in the foregoing example embodiment, the oil-level error warning lamp 46 may be activated in different manners for an accidental disconnection of the upper switch 52*a* and dilution of the oil. For example, the light color of the oil-level error warning lamp 46 or the blink interval may be changed. Further, two lamps may be provided to indicate an accidental disconnection of the upper switch 52*a* and dilution of the oil, respectively.

(c) While the oil pan is provided in the diesel engine 2 in the foregoing example embodiment, if there is a possibility that the oil amount becomes excessive due to dilution of the oil, etc., the invention may be applied to an oil of a gasoline engine.

(d) While the lower oil level detector 50 is turned on when the oil level is lower than the first reference oil level LVL1 and turned off when the oil level is higher than the first reference oil level LVL1 in the foregoing example embodiment as indicated in FIG. 2 and FIG. 3, the orientation of the lower oil level detector 50 may be reversed upside down. In this case, the lower oil level detector 50 is turned off when the oil level is lower than the first reference oil level LVL1 and turned on when the oil level is higher than the first reference oil level LVL1.

While the upper oil level detector 52 is turned on when the oil level is higher than the second reference oil level LVL2 and turned off when the oil level is lower than LVL2 in the foregoing example embodiment as shown in FIG. 2 and FIG. 3, the orientation of the upper oil level detector 52 may be reversed upside down. In this case, the upper oil level detector 52 is turned off when the oil level is higher than the second reference oil level LVL2 and turned on when the oil level is lower than the second reference oil level LVL2.

Further, while the position of the lower oil level detector 50 and the position of the upper oil level detector 52, which are indicated in FIG. 2 and FIG. 3, may be reversed and their ON-OFF manners may be reversed as in the examples mentioned above.

When the ON-OFF manners of the lower oil level detector 50 and the upper oil level detector 52 are reversed as mentioned above, the manners of the respective determinations as to the output values OILL, OILH and the upper-switch initial value OILHini are also reversed.

In particular, when the ON-OFF manner of the upper oil level detector 52 is reversed as mentioned above, a short-circuit (including an operation failure to turn the upper switch 52*a* off) is detected instead of disconnection of the upper oil level detector 52 (including an operation failure to turn the upper switch 52*a* on).

(e) While the oil level detectors 50, 52, which are adapted to output ON signals and OFF signals using the switches 50*a*, 52*a*, respectively, are used in the foregoing example embodiment, other devices or systems may alternatively be used as long as they have detecting portions whose outputs change as the oil level changes across the first reference oil level LVL1 or across the second reference oil level LVL2.

While the invention has been described with reference to example embodiments thereof, it is to be understood that the invention is not limited to the example embodiments or constructions. To the contrary, the invention is intended to cover various modifications and equivalent arrangements. In addition, while the various elements of the example embodiments are shown in various combinations and configurations, which are example, other combinations and configurations, including more, less or only a single element, are also within the spirit and scope of the invention.

What is claimed is:

1. An abnormality detection apparatus for detecting an abnormality of an oil level sensor having a lower oil level detector adapted to produce an output that changes as an oil level in an oil pan of an internal combustion engine changes across a first reference oil level and an upper oil level detector adapted to produce an output that changes as the oil level in the oil pan changes across a second reference oil level that is higher than the first reference oil level, the first reference oil level and the second reference oil level being set such that the oil level falls between the first reference oil level and the second reference oil level when the internal combustion engine is operating and the oil level is higher than the second reference oil level when the internal combustion engine is not operating, the abnormality detection apparatus comprising:

a pre-engine-start upper-oil-level-detector output recording portion that records an output of the upper oil level detector before the internal combustion engine is started; and an abnormality determining portion that determines that the upper oil level detector has an abnormality if the output of the lower oil level detector is indicating, after the start of the internal combustion engine, that the oil level is higher than the first reference oil level while the output of the upper oil level detector recorded by the pre-engine-start upper-oil-level-detector output recording portion is indicating that the oil level was lower than the second reference oil level before the start of the internal combustion engine.

2. The abnormality detection apparatus according to claim 1, wherein the pre-engine-start upper-oil-level-detector output recording portion records the output of the upper oil level detector in a state where an ignition switch is at an ON position and a crankshaft of the internal combustion engine is not rotating before the internal combustion engine is started.

3. The abnormality detection apparatus according to claim 1, further comprising:

an engine-stop-time-period determining portion that measures or estimates a time period for which the internal combustion engine was off and determines whether the measured or estimated time period is equal to or longer than a reference time period, wherein the abnormality determining portion performs the determination as to an abnormality of the upper oil level detector using the output of the upper oil level detector recorded by the pre-engine-start upper-oil-level-detector output recording portion when the engine-stop-time-period determining portion determines that the time period for which the internal combustion engine was off after the internal combustion engine was stopped the last time is equal to or longer the reference time period.

4. The abnormality detection apparatus according to claim 3, wherein the engine-stop-time-period determining portion estimates the time period for which the internal combustion engine was off based on a decrease in the temperature of the internal combustion engine.

5. The abnormality detection apparatus according to claim 4, wherein the engine-stop-time-period determining portion includes an engine-off temperature recording portion that records a first temperature representing the temperature of the internal combustion engine immediately after the ignition switch is turned to an OFF position and a second temperature representing the temperature of the internal combustion engine immediately after the ignition switch is turned to the ON position, and the engine-stop-time-period determining portion determines that the time period for which the internal combustion engine was off after the internal combustion engine was stopped the last time is longer than the reference time period if the second temperature is equal to or lower than a reference temperature and the value obtained by subtracting the second temperature from the first temperature is equal to or larger than a reference temperature difference.

6. The abnormality detection apparatus according to claim 1, wherein the abnormality determining portion performs the determination as to an abnormality of the upper oil level detector using the output of the upper oil level detector recorded by the pre-engine-start upper-oil-level-detector output recording portion when the rotation speed of the crankshaft of the internal combustion engine is equal to or higher than a reference rotation speed.

7. The abnormality detection apparatus according to claim 1, further comprising:

an abnormality addressing portion that, when an abnormality of the upper oil level detector has been repeatedly detected a predetermined number of times in a row, executes an abnormity addressing process to address the detected abnormality of the upper oil level detector.

8. The abnormality detection apparatus according to claim 1, wherein an output value of the upper oil level detector obtained when the internal combustion engine is operating is used in an oil-dilution determination process for determining whether the oil is diluted.

9. The abnormality detection apparatus according to claim 8, wherein it is determined that the oil is diluted when the output of the upper oil level detector, when the internal combustion engine is being operated, is indicating that the oil level in the oil pan is higher than the second reference oil level despite that the upper oil level detector has been determined to have no abnormality.

10. The abnormality detection apparatus according to claim 8, wherein the oil-dilution determination process is executed, when a state where the upper oil level detector is determined to have no abnormality is satisfied, and when at least one of a state where the temperature of the internal combustion engine is equal to or higher than a predetermined temperature and a state where the rotation speed of the crankshaft of the internal combustion engine is within a predetermined range has continued for a predetermined time or longer is satisfied.

11. The abnormality detection apparatus according to claim 1, wherein the internal combustion engine is a diesel engine in which fuel is injected to increase the temperature of an exhaust purification device.

12. The abnormality detection apparatus according to claim 11, wherein the fuel injection for increasing the temperature of the exhaust purification device is stopped if the upper oil level detector is presently determined to have an abnormality by the abnormality determining portion and a vehicle incorporating the diesel engine has already traveled a predetermined distance or longer.

13. The abnormality detection apparatus according to claim 8, wherein the internal combustion engine is a diesel engine in which fuel is injected to increase the temperature of an exhaust purification device.

14. The abnormality detection apparatus according to claim 13, wherein the fuel injection for increasing the temperature of the exhaust purification device is stopped when at least one of a state where the upper oil level detector is presently determined to have an abnormality by the abnormality determining portion while a vehicle incorporating the internal combustion engine has already traveled a predetermined distance or longer and a state where the oil is presently determined, in the oil-dilution determination process, to be diluted while the vehicle has already traveled the predetermined distance or longer is satisfied.

15. An abnormality detection method for detecting an abnormality of an oil level detecting sensor having a lower oil level detector adapted to produce an output that changes as an oil level in an oil pan of an internal combustion engine changes across a first reference oil level and an upper oil level detector adapted to produce an output that changes as the oil level in the oil pan changes across a second reference oil level that is higher than the first reference oil level, the first reference oil level and the second reference oil level being set such that the oil level falls between the first reference oil level and the second reference oil level when the internal combustion engine is operating and the oil level is higher than the second reference oil level when the internal combustion engine is not operating, the abnormality detection method comprising:

recording an output of the upper oil level detector before the internal combustion engine is started; and determining that the upper oil level detector has an abnormality if the output of the lower oil level detector is indicating, after the start of the internal combustion engine, that the oil level is higher than the first reference oil level while the recorded output of the upper oil level detector is indicating that the oil level was lower than the second reference oil level before the start of the internal combustion engine.

* * * * *